United States Patent [19]

Jackson

[11] Patent Number: 4,793,664

[45] Date of Patent: Dec. 27, 1988

[54] CABINET STRUCTURE AND SHELVING APPARATUS THEREFOR

[76] Inventor: Charles Jackson, Rte. #3, Box 428-B, Newton, N.C. 28658

[21] Appl. No.: 545,452

[22] Filed: Oct. 26, 1983

[51] Int. Cl.[4] ..... A47B 57/00

[52] U.S. Cl. ..... 312/306; 108/107; 211/153

[58] Field of Search ..... 312/132, 148, 128, 129, 312/257 SK, 257 R, 257 SM, 193, 293, 350, 351, 306; 108/48, 107, 109, 1, 110; 211/98, 128, 153, 150, 208

[56] References Cited

U.S. PATENT DOCUMENTS

| | | | |
|---|---|---|---|
| 1,584,139 | 5/1926 | Porter | 108/49 |
| 1,684,707 | 9/1928 | LaHatte | 108/1 |
| 1,980,116 | 11/1934 | Toborg | 211/153 |
| 2,011,189 | 8/1935 | Anderson | 312/293 |
| 2,346,430 | 4/1944 | Hauser | 312/293 |
| 2,839,350 | 6/1958 | Hill et al. | 312/351 |
| 3,087,764 | 4/1983 | Schless | 312/351 |
| 3,341,270 | 9/1967 | Sohl | 312/257 R |
| 3,359,644 | 12/1967 | Goldman | 108/1 |
| 3,366,432 | 1/1968 | Cramer | 312/351 |
| 3,810,430 | 5/1974 | Siegal | 108/109 |
| 4,053,132 | 10/1977 | Del Pozzo | 108/109 |
| 4,292,902 | 10/1981 | Barrineau | 108/110 |
| 4,379,431 | 4/1983 | Clement | 108/1 |

*Primary Examiner*—Joseph Falk

*Attorney, Agent, or Firm*—Shefte, Pinckney & Sawyer

[57] ABSTRACT

A shelving apparatus for incorporation in conventional cabinet structures commonly referred to as "lockers" for providing supplementary shelves therein, including a shelf support plate adapted for upstanding disposition on the locker floor to extend along its rear wall in contact therewith and one or more shelves adapted to be engaged by tabs thereon in corresponding slots in the support plate and being of a greater longitudinal dimension than the depth-wise dimension of the locker so as to extend from the support plate at an upward incline and to resting braced engagement with the flanges laterally adjacent the locker door at the forward side of the locker. The apparatus may be retrofit into conventional existing lockers or incorporated in the construction of new lockers to provide greater storage organizational capabilities therein.

23 Claims, 2 Drawing Sheets

CABINET STRUCTURE AND SHELVING APPARATUS THEREFOR

BACKGROUND OF THE INVENTION

The present invention relates generally to storage cabinets and like structures and particularly to such structures of the type commonly referred to as "lockers" such as are typically provided in gymnasiums and like places for individual storage of one's personal sports equipment, clothes and the like.

Storage "lockers" of the above-described type are generally constructed as upright rectangular enclosures defining a relatively small storage space intended to be sufficient for use ordinarily by only one person for temporary storage of clothing and small personal items such as sports equipment. Such lockers are typically found in large numbers at gymnasiums, health spas, sports clubs and similar establishments for purposes of providing the patrons with individual storage areas which they may employ for storage of their personal equipment ordinarily used at the establishment and for convenient clothes changes into the appropriate attire. Generally, such lockers are rather barely appointed, ordinarily providing only single shelf at or near the upper end of the locker for supporting relatively small articles and one or more hooks or other support members in the area below the shelf for hanging support of clothes or the like. Such lockers are rather widely considered to be greatly inadequate for their intended storage purposes, due to a considerable extent to the lack of interior appointments providing for organized storage of various common clothing and other articles.

In contrast, the present invention provides a shelving apparatus adapted either to the readily fitted into existing lockers for providing additional shelves therein or to be incorporated into the construction of new lockers for the same purpose.

SUMMARY OF THE INVENTION

In one aspect, the present invention provides a shelving apparatus adapted to be incorporated in a cabinet structure of the type basically having a vertical rear wall, a front access opening, and vertical front frame members laterlly adjacent to the opening. Briefly described, the shelving apparatus includes a shelf support member adapted to be received in the cabinet structure in upstanding relation along the rear cabinet wall and at least one shelf member adapted to be engaged with the shelf support member and to extend therefrom into resting engagement with the inward surfaces of the front cabinet frame members to present a generally flat upwardly facing shelf surface. The shelf support member presents plural vertically spaced receiving openings facing the front frame members and the shelf member includes projecting portions at one side thereof for selective receipt in the receiving openings and is dimensioned from its one side to its opposite side to be sufficiently greater than the dimension between the support member when disposed in the cabinet and the front frame members thereof so that the shelf member will extend at an upward incline from the support member into edgewise resting engagement with the inward surfaces of the front frame members. In this manner, the shelving apparatus provides for the addition of one or more shelves to the cabinet structure for enhanced organization of the storage capabilities of the cabinet structure.

In another aspect of the present invention, there is provided a cabinet structure which, briefly described, includes a vertical rear wall arrangement, a front access opening, vertical front frame members laterally adjacent the opening, plural vertically spaced receiving openings formed in the rear wall arrangement and facing the front frame members, and at least one shelf member of substantially the same basic construction as described above supported by the rear wall arrangement and extending therefrom to and resting upon the inward surfaces of the front frame members in the same manner as aboved-described. In one embodiment, the rear wall arrangement includes a rear cabinet wall and a shelf support member extending in upstanding relation there along as above described with the receiving openings being formed in the shelf support member. In another embodiment, the rear wall arrrangement is the rear cabinet wall with the receiving openings being formed therein.

It is preferred in both aspects of the present invention that the cabinet structure include two vertical side walls extending between the rear wall and the front frame members and further include top and bottom walls defining with the rear and side walls an interior storage area. The front frame members are preferably formed as vertical flanges extending toward one another from the forward vertical edges of the side wall. It is also preferred that a door be hingably mounted to one of the flange members for opening and closing the access opening to the storage area.

In the preferred embodiments in the present invention according to each aspect thereof, the shelf support member is a substantially flat plate adapted to stand on its edge on the bottom cabinet wall adjacent the corner thereof with the rear cabinet wall and to extend in substantially flush surface engagement parallel with the rear cabinet wall. The shelf support member includes plural spaced vertical ribs projecting therefrom inwardly of the storage area, in each of which ribs the receiving openings of the shelf member are formed as slots at corresponding vertical spacings. The shelf member is substantially planer in a shape substantially correponding to the cross-sectional shape of the cabinet structure and includes plural projecting tabs on its aforesaid one side corresponding in number and spacing to the ribs of the shelf support member.

DESCRIPTION OF THE PREFERRED EMBODIMENT

Figure 1:
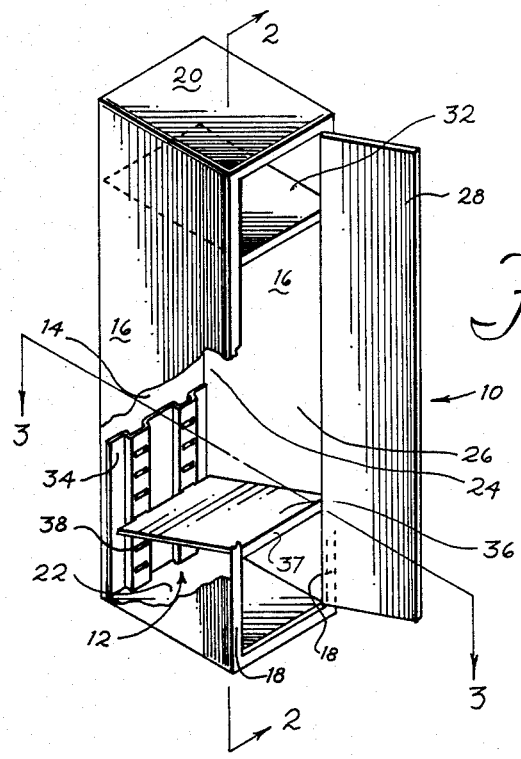
FIG. 1 is a perspective view of a locker-type cabinet structure incorporating the shelving apparatus of the present invention.

Referring now to the accompanying drawings and initially to FIG. 1, a locker-type cabinet of the conventional type above-described is indicated generally at 10 and has incorporated therein the shelving apparatus of the present invention indicated generally at 12 thereby providing an improved cabinet structure according to the present invention.

The locker 10 is constructed substantially entirely of sheet metal wall components bent, welded, rivoted or otherwise fixedly joined to provide a relatively tall vertically upstanding rectangular rear wall 14 from the opposite lateral side edges of which extend respectively in parallel relation two vertically upstanding side walls 16 of a corresponding longitudinal dimension. Two vertically upstanding flange members 18 extend respectively from the forward vertical side edges of the side walls 16 coplanarly toward one another in parallel relation with the rear wall 14. A rectangular top wall or ceiling 20 and a rectangular bottom wall or floor 22 of substantially identical construction are affixed to the respective top and bottom edges of the rear and side walls, 14,16 and of the flange members 18 to define therewith an interior storage area 24. The flange members 18 in conjunction with the forward edges of the top and bottom walls 20,22 define a front access opening 26 to the storage area. A door 28 dimensioned substantially identically with the access opening 26 is pivotable affixed to one flange member 18 along a vertical axis by a hinge member 30 for selectively opening and closing the access opening 26, suitable latching and locking members, not shown, being provided on the other flange member 18 and the mating vertical side of the door 28 opposite the hinge member 30. As is conventional and typical, a single rectangular shelf member 32 is fixedly mounted in a horizontal disposition at the upper end of the storage area 24 respectively to and extending between the rear and side walls 14,16. The main area of the storage area 24 below the shelf 32 is ordinarily open entirely with only one or more hook or similar members (not shown) affixed to one or more of the rear side walls 14,16 or the underside of shelf 32 for hanging support of clothing, sports articles, or other such items to be stored. Because of the relative lack of appropriate provisions in lockers such as the locker 10 for organized storage of such items, such items are usually arranged in the storage area 24 in relative disarray, particularly when there are stored a number of relatively small items such as shoes and the like which cannot be appropriately be hung from one of the hooks, such items typically being stacked or piled atop one another either on the shelf 32 or on the bottom wall 22 or both.

Figure 2:
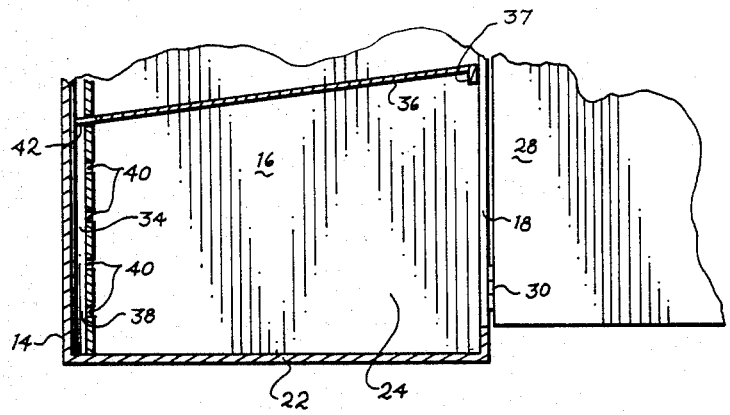
FIG. 2 is a vertical cross-sectional view of the cabinet structure of FIG. 1 taken along line 2—2 thereof.
Figure 3:
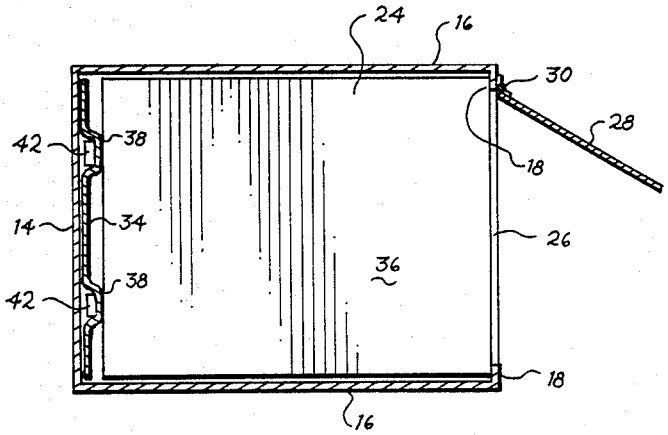
FIG. 3 is a horizontal cross-sectional view of the cabinet structure taken along line 3—3 thereof.

The shelving apparatus 12 of the present invention provides a solution to the foregoing problem by facilitating the provision of one or more shelves in the lower end of the storage area 24. Basically, the shelving apparatus 12 includes a shelf support plate 34 and one or more shelf members 36, each preferably constructed of the same sheet metal or similar material from which the locker 10 is fabricated. For clarity of illustration, only one shelf member 36 is shown in the accompanying drawings, it being understood that additional shelves 36 may be employed as desired. The shelf support plate 34 is of a planer rectangular construction having a width-wise dimension approximately the same or only slightly less than the interior widthwise dimension of the rear wall 14 so as to be adapted to be received in the storage area for standing therein on one width-wise edge of the support plate 34 on the bottom wall 22 adajacent the corner thereof with the rear wall 14 and extending vertically along the rear wall 14 in surface contact thereagainst and parallel relation therewith (see FIG. 2) The shelf support plate 34 is formed with two longitudinally extending ribs 38 spaced width-wise equidistantly on opposite sides of the longitudinal center of the plate 34 so as to extend vertically therewith in the upstanding disposition thereof in the storage area, the shelf support plate being arranged in the storage area 34 with the ribs 38 projecting inwardly of the storage area 24 toward the flange members 18 and the access opening 26 at the forward site of the locker 10. A plurality of horizontal slots 40 are formed at corresponding vertical spacings in each rib 38. The shelf member 36 is substantially of a planer rectangular construction of substantially the same width-wise dimension as the shelf support plate 34 so as to be approximately the same or only slightly less than the width-wise interior dimension of the storage area 24 and of a longitudinal dimension slightly greater than the depth-wise dimension of the storage area 24 between the ribs 38 of the support plate 34 when disposed therein and the surfaces of the flange members 18 inwardmost of the storage area 24. The shelf member 36 includes a pair of generally square tabs 42 projecting from one width-wise edge of the shelf member 36 coplanarly with the remainder thereof at spaced locations along such width-wise edge corresponding to the locations of the slots 40 of the shelf support plate 34. A downwardly and reversely bent lip 37 is formed at the opposite width-wise edge of the shelf member 36.

In use, the shelf support plate 34 is arranged in the storage area 24 in the aforedescribed upstanding disposition on the bottom wall 22. Each shelf member 36 is selectively arranged in the storage area 24 with its width-wise edge from which the tabs 42 extend in edgewise abutment with the shelf support plate 34 with the tabs 42 selectively inserted through corresponding slots 40 in the ribs 38 and, by virtue of the greater longitudinal dimension of the shelf member 36 than the depth-wise dimension of the storage area 24, the shelf member 36 extending from the shelf support plate longitudinally at a slight upward incline into braced resting engagement by its opposite width-wise edge with the inward surfaces of the flange members 18 so as to present a generally horizontal, flat, upwardly facing shelf surface for article storage thereon.

The advantages of the present invention will thus be understood. First and of primary importance, the shelving apparatus 12 of the present invention readily provides a simple and inexpensive construction by which one or several shelves may be provided in the lower end of a conventional locker-type cabinet to greatly enhance the storage organizational capabilties of the locker while still leaving a substantial intermediate area of the locker storage area 24 in which clothing articles and the like may be neatly hung in ordinary manner without restriction or interference by the shelving apparatus 12. Thus, the present invention avoids the inconvenience and disadvantages of the necessity heretofore of disorganized stacking and piling of articles in the lower area of the storage area 24 of the locker and instead permits neat and organized storage of such articles on the shelf members 36. Advantageously, the shelving apparatus 12 may readily be constructed for retrofitting in existing conventional lockers to provide the foregoing advantages or, alternatively, may be incorporated readily and without significant modification in the construction of new lockers. Furthermore, those persons skilled in the art will readily recognize that the present invention may be equally adapted for use in conventional cabinet structures other than lockers to provide supplementary shelving therein.

Figure 4:
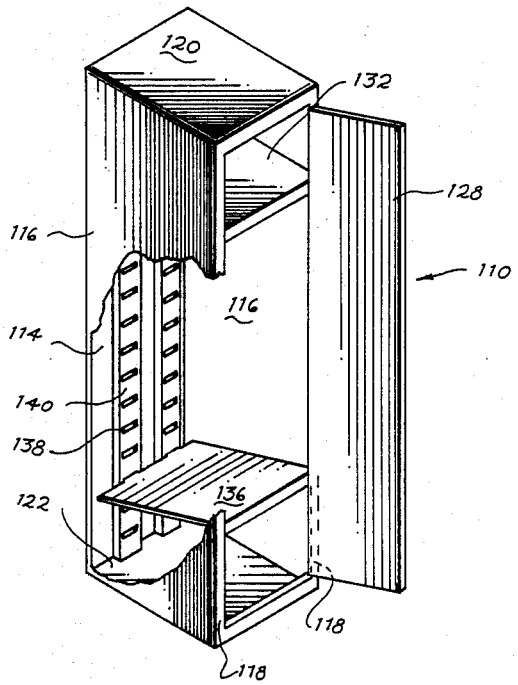
FIG. 4 is a perspective view of another locker-type cabinet structure according to the present invention.

Another embodiment of the present invention is illustrated in FIG. 4 wherein is illustrated a locker-type cabinet structure 110 in which the present invention has been incorporated in the original construction thereof. The locker 110 is of substantially the same construction as the aforedescribed locker 10, including a rear wall 114, two side walls 116, forward flange members 118, top and bottom walls 120,122, a single fixed upper shelf 132, and a door 128, but rather than employing a separate shelf support member the rear wall 114 has been originally formed with two horizontally spaced, vertically extending ribs 138 in each of which are correspondingly formed plural vertically-spaced horizontal slots 140. Thus, the rear wall 114 is adapted to receive in its slots 140 the tabs 142 of a shelf member 136 identical in construction to the above-described shelf member 36. In this manner, the locker 110 may be utilized either without any additional shelf members 136 or may be provided as desired with one or more shelf member 136 to attain the above-described advantages.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. A shelving apparatus adapted for use in a cabinet structure having a vertical rear wall, a front access opening, and vertical front frame members laterally adjacent said opening, said shelving apparatus comprising a shelf support member adapted to be removably received in said cabinet structure in upstanding relation along said rear wall and presenting plural vertically spaced receiving openings facing said front frame members, and at least one shelf member adapted to be received in said cabinet structure and having projecting means at one side thereof for selective receipt in said receiving openings of said support member and dimensioned from said one side to the opposite side of said shelf member to be sufficiently greater than the dimension between said support member when disposed in said cabinet and said front frame members thereof so that said shelf member will extend at an upward incline from said support member into braced edgewise resting engagement of said opposite side of said shelf member with the inward surfaces of said front frame members to present a generally flat, upwardly facing shelf surface without other means for supporting said shelf member, thereby for enhanced organiztion of the storage capabilities of said cabinet structure.

2. A shelving apparatus according to claim 1 and characterized further in that said shelf support member is a substantially flat plate adapted for substantially flush surface engagement with said rear wall parallel thereto.

3. A shelving apparatus according to claim 1 and characterized further in that said shelf support member includes plural spaced vertical ribs in each of which said receiving openings are formed as slots at corresponding vertical spacings.

4. A shelving apparatus according to claim 3 and characterized further in that said shelf member includes plural projecting tabs on its said one side corresponding in number and spacing to said ribs of said shelf support member.

5. A shelving apparatus according to claim 4 and characterized further in that said shelf support member is a substantially flat plate adapted for substantially flush surface engagement with said rear wall parallel thereto.

6. A shelving apparatus according to claim 5 and characterized further in that said cabinet includes a bottom wall, said shelf support members being adapted to stand on its edge on said bottom wall adjacent said rear wall.

7. A shelving apparatus according to claim 6 and characterized further in that said shelf member is substantially planar and is of a shape substantially corresponding to the cross-sectional shape of said cabinet structure.

8. A shelving apparatus according to claim 4 and characterized further in that said cabinet includes a bottom wall, said shelf support member being adapted to stand on its edge on said bottom wall adjacent said rear wall.

9. A shelving apparatus according to claim 1 and characterized further in that said cabinet includes a bottom wall, said shelf support member being adapted to stand on its edge on said bottom wall adjacent said rear wall.

10. A shelving apparatus according to claim 1 and characterzied further in that said shelf member is substantially planar and is of a shape substantially corresponding to the cross-sectional shape of said cabinet structure.

11. A cabinet structure comprising vertical rear wall means, a front access opening, vertical front frame members laterally adjacent said opening, plural vertically spaced receiving openings formed in said rear wall means and facing said front frame members, and at least one shelf member having projecting means at one side thereof for selective receipt in said receiving openings and dimensioned from said one side to the opposite side of said shelf member to be sufficiently greater than the dimension between said rear wall means and said front frame members so that said shelf member will extend at an upward incline from said rear wall means into braced edgewise resting engagement of said opposite side of said shelf member with the inward surfaces of said front frame members to present a generally flat, upwardly facing shelf surface without other means for supporting said shelf member, thereby for enhanced organization of the storage capabilities of said cabinet structure.

12. A cabinet structure according to clam 11 and characterized further in that said rear wall means comprises a rear cabinet wall and a substantially flat shelf support plate adpated for substantially flush surface engagement with said rear wall parallel thereto.

13. A cabinet structure according to claim 12 and characterized further in that said shelf support member includes plural vertical ribs in each of which said receiving openings are formed as slots at corresponding vertical spacings.

14. A cabinet structure according to claim 13 and characterized further in that said shelf member includes plural projecting tabs on its said one side corresponding in number and spacing to said ribs of said shelf support member.

15. A cabinet structure according to claim 14 and characterized further in that said cabinet includes a bottom wall, said shelf support member adapted to stand on its edge on said bottom wall adjacent said rear wall.

16. A cabinet structure according to claim 15 and characterized further in that said shelf member is substantially planar and is of a shape substantially corresponding to the cross-sectional shape of said cabinet structure.

17. A cabinet structure according to claim 12 and characterized further in that said cabinet includes a bottom wall, said shelf support member adapted to stand on its edge on said bottom wall adjacent said rear wall.

18. A cabinet structure according to claim 11 and characerized further in that said shelf member is substantially planar and is of a shape substantially corresponding to the cross-sectional shape of said cabinet structure.

19. A cabinet structure according to claim 11 and characterized further in that said rear wall is a rear cabinet wall in which are formed said receiving openings.

20. A cabniet structure according to claim 19 and characterized further in that said rear cabinet wall includes plural vertical ribs in each of which said receiving openings are formed as slots at corresponding vertical spacings.

21. A shelving apparatus adapted for use in a locker-type cabinet of the type having a vertical rear wall, two vertical side walls, a top wall and a bottom wall defining therewithin a storage area and having vertical flange members extending toward one another from the respective forward vertical edges of said side walls and defining therebetween a front access opening to said storage area, and a door for opening and closing said access opening, said shelving apparatus comprising a support plate adapted to be removably received in said storage area for edgewise standing therein on said bottom wall adjacent the corner thereof with said rear wall and for extending vertically in surface contact against and in parallel relation with said rear wall, said support plate having spaced, vertical ribs, projecting inwardly of the storage area in each of which ribs are formed plural vertically spaced receiving openings for facing said flange members, and at least one planar shelf member configured and dimensioned in general correspondence to the cross-sectional shape and dimensions of said storage area with the dimension between front and back edges of said shelf member being slightly greater than the dimension of said storage area between said support plate and said flange members, said shelf member having spaced projections along its said back edge and being adapted for disposition transversely in said storage area with said projections received in selected ones of said receiving openings of said support plate and for extending generally horizontally at a slight upward incline from said support plate into bracing edgewise resting engagement of said front edge if said shelf member with the inward surfaces of said flange members to present a flat, upwardly facing shelf surface without other means for supporting said shelf member, thereby for enhanced organization of the storage capabilities of said cabinet structure.

22. In a locker-type cabinet structure of the type having a vertical rear wall, two vertical side walls extending forwardly from opposite sides of said rear wall, top and bottom walls extending between the upper and lower edges of said rear and side walls and defining therewith an interior storage area, two vertical flange members extending toward one another from the respective forward vertical edges of said side walls and defining therebetween a front access opening to said storage area, and a door hingedly mounted to one said flange member for opening and closing said access opening, the improvement comprising a shelving apparatus removably disposed within said storage area for providing auxiliary shelves therein, comprising a support plate standing edgewise in said storage area on said bottom wall adjacent the corner thereof with said rear wall and extending vertically in surface contact against and in parallel relation with said rear wall, said support plate having spaced, vertical ribs projecting inwardly of the storage area in each of which ribs are formed plural vertically spaced receiving openings facing said flange members, and at least one planar shelf member configured and dimensioned in general correspondence to the cross-sectional shape and dimensions of said storage area with the dimension between front and back edges of said shelf member being slightly greater than the dimension of said storage area between said support plate and said flange members, said shelf member having spaced projections along its said back edge and being disposed transversely in said storage area with said projections received in selected ones of said receiving openings of said support plate and extending generally horizontally at a slight upward incline from said support plate into bracing edgewise resting engagement of said front edge of said shelf member with the inward surfaces of said flange members to present a generally flat, upwardly facing shelf surface without other means for supporting said shelf member, thereby for enhanced organization of the storage capabilities of said cabinet structure.

23. In a locker-type cabinet structure of the type having a vertical rear wall, two vertical side walls extending between the upper and lower edges of said rear and side walls and defining therewith an interior storage area, two vertical flange members extending toward one another from the respective forward vertical edges of said side walls and defining therebetween a front access opening to said storage area, and a door hingedly mounted to one said flange member for opening and closing said access opening, the improvement comprising plural vertically spaced receiving openings formed in said rear wall facing said flange members, and at least one planar shelf member configured and dimensioned in general correspondence to the cross-sectional shape and dimensions of said storage area with the dimension between front and back edges of said shelf member being slightly greater than the dimension of said storage area between said rear wall and said flange members, said shelf member having spaced projections received in selected ones of said receiving openings of said rear wall and extending generally horizontally at a slight upward incline therefrom into bracing edgewise resting engagement of said front edge of said shelf member with the inward surfaces of said flange members to present a generally flat, upwardly facing shelf surface without other means for supporting said shelf member, thereby for enhanced organization of the storage capabilities of said cabinet structure.

* * * * *